US011118383B2

(12) United States Patent
Grisendi

(10) Patent No.: US 11,118,383 B2
(45) Date of Patent: Sep. 14, 2021

(54) CLAMPING DEVICE

(71) Applicant: Speedy Block Grisendi s.r.l. più brevemente Speedy Block s.r.l., Locate di Triulzi (IT)

(72) Inventor: Gualtiero Guido Grisendi, Trezzano Sul Naviglio (IT)

(73) Assignee: SPEEDY BLOCK GRISENDI S.R.L. PIÚ BREVEMENTE SPEEDY BLOCK S.R.L., Locate di Triulzi (IT)

( * ) Notice: Subject to any disclaimer, the term of this patent is extended or adjusted under 35 U.S.C. 154(b) by 846 days.

(21) Appl. No.: 15/099,676

(22) Filed: Apr. 15, 2016

(65) Prior Publication Data

US 2016/0305172 A1 Oct. 20, 2016

(30) Foreign Application Priority Data

Apr. 16, 2015 (IT) ..... 102015000012013
Apr. 16, 2015 (IT) ..... 102015000012020

(51) Int. Cl.
*E05C 19/12* (2006.01)
*E05C 3/14* (2006.01)

(52) U.S. Cl.
CPC ..... *E05C 19/12* (2013.01); *E05C 3/14* (2013.01)

(58) Field of Classification Search
CPC ..... E05C 19/14; E05C 19/145; E05C 19/12; E05C 3/14; Y10T 24/44333;
(Continued)

(56) References Cited

U.S. PATENT DOCUMENTS 4,141,543 A * 2/1979 Kato ..... B25B 5/12 269/228
4,385,423 A 5/1983 Vermilye
(Continued)

FOREIGN PATENT DOCUMENTS

DE 102008011462 A1 9/2009
DE 102008017447 A1 10/2009
(Continued)

OTHER PUBLICATIONS

Search Report and Written Opinion in priority Italian application 102015000012013, dated Dec. 4, 2015.
(Continued)

*Primary Examiner* — Mark A Williams
(74) *Attorney, Agent, or Firm* — Kristina Castellano; Castellano PLLC

(57) ABSTRACT

A clamp device comprises a base on which is pivoted a handle which is rotatable about a pivot pin for opening and/or closing the clamp device, a closing device adapted to engage with a clamp element to close the clamp device in a closed configuration, and a locking device for locking the clamp device in the closed configuration hinged by a hinge pin to the handle so that it can be moved between a locking position, in which, in the closed configuration, a catch element of the locking device interacts with the base to attach the clamp device to the base, and a release position in which the handle is free to rotate relative to the base, the locking device comprises a stroke limiting device to limit the rotation of the locking device from the locking position.

16 Claims, 10 Drawing Sheets

(58) Field of Classification Search
CPC ..... Y10T 24/2196; Y10T 292/20; Y10T 292/216; B25B 5/12; B25B 1/14; Y10S 292/49; Y10S 292/31
See application file for complete search history.

(56) References Cited

U.S. PATENT DOCUMENTS

| | | | | |
|---|---|---|---|---|
| 5,165,148 | A | 11/1992 | Fleischer et al. | |
| 5,445,422 | A | 8/1995 | Weinerman et al. | |
| 5,667,261 | A * | 9/1997 | Weinerman | E05C 19/14 292/113 |
| 6,374,465 | B1 * | 4/2002 | Dykstra | B25B 5/12 24/68 CD |
| 6,932,335 | B1 * | 8/2005 | Dykstra | B25B 5/12 269/201 |
| 2005/0077736 | A1 * | 4/2005 | Hagan | E05C 19/14 292/247 |
| 2006/0076785 | A1 * | 4/2006 | Eriksson | E05C 19/14 292/247 |
| 2008/0217829 | A1 * | 9/2008 | Martin | B25B 5/12 269/228 |
| 2010/0181710 | A1 * | 7/2010 | Martin | E05C 19/14 269/6 |
| 2017/0203412 | A1 * | 7/2017 | Grobbel | B25B 5/12 |

FOREIGN PATENT DOCUMENTS

| | | | |
|---|---|---|---|
| DE | 102010046943 | A1 | 4/2011 |
| EP | 1179393 | A1 | 2/2002 |
| WO | 2011/099946 | A2 | 8/2011 |
| WO | 2014/177539 | A1 | 11/2014 |

OTHER PUBLICATIONS

Search Report and Written Opinion in priority Italian application 102015000012020, dated Jan. 7, 2016.

* cited by examiner

CLAMPING DEVICE

CLAIM FOR PRIORITY

This application claims priority to Italian Patent applications IT 102015000012013 filed on Apr. 16, 2015 and IT 102015000012020 filed on Apr. 16, 2015, the contents of both of which are incorporated herein by reference.

TECHNICAL FIELD

The present invention relates to a clamp device having a safety lever according to the characteristics disclosed in the preamble of the independent claim.

The clamp device of the invention may be a vertical or horizontal clamp device and may be of the strap type if required.

PRIOR ART

In industry, clamp devices are commonly used to clamp, for example, two parts of a container to be kept closed, or two parts of a casing, or to clamp a cover on to a corresponding container.

In some applications, the container or casing may be subject to vibrations, possibly of considerable intensity. These vibrations may cause the undesired and unpredictable opening of the clamp device and consequently of the container closed by the clamp device, which may endanger operators or cause damage to equipment.

In applications where high stresses due to vibration are present, it is therefore advisable to use clamp devices having additional locking devices, called "safety devices" in the terminology of the field, to keep the clamp devices in the closed position.

Clamp devices of the aforesaid type are known, for example, from U.S. Pat. No. 5,165,148.

The clamp device described in U.S. Pat. No. 5,165,148 comprises a first base portion adapted to be screwed on to a first portion of a container to be locked, on which is hinged a handgrip which can be actuated by an operator to open and/or close the clamp device; a U-shaped coupling element is fastened to the handgrip and is moved by actuating the handgrip.

The clamp device further comprises a second base portion adapted to be screwed on to a second portion of a container to be locked, and is provided, on the opposite side from the first base portion, with a recess adapted to house the coupling element to keep the clamp device in the closed position.

The clamp device of U.S. Pat. No. 5,165,148 further comprises a safety lever hinged on the handgrip and provided with an appendage adapted to be housed in a recess provided on the first base portion to attach the safety lever to the first base portion.

The safety lever further comprises a handle, positioned between the handgrip and the first base portion, which is designed to be actuated by the operator in order to engage the appendage in the recess or disengage it therefrom, and which can therefore lock or unlock the engagement device, respectively.

A drawback of this engagement device is that the operations of opening and closing it are time-consuming for an operator.

In order to open the device, it is necessary to grasp the handle, unlock the lever from the cavity and unlock the coupling element from the recess; similarly, in order to close the device, it is necessary to actuate both the handgrip and the coupling, in addition to the safety lever.

The operator is obliged to carry out the aforesaid operations by using both hands; in particular, the operator has to use one hand to take hold of the handgrip and unlock the lever from the cavity, while his other hand is used to release the coupling element from the recess.

Moreover, with these devices there is a risk that the operator may injure himself while actuating the handgrip or the safety lever.

As well as being inconvenient, therefore, the use of the clamp device of U.S. Pat. No. 5,165,148 is not very safe or reliable for an operator.

DESCRIPTION OF THE INVENTION

The problem tackled by the present invention is that of providing a clamp device which is structurally and functionally designed to overcome the limitations described above with reference to the cited prior art.

In the context of this problem, one object of the invention is to provide a clamp device having a locking device which is convenient to actuate and easy to lock, while also being safe for the operator.

Another object of the invention is to provide a clamp device which can be opened and/or closed using only one hand.

Another object of the invention is to provide a clamp device which is automatically locked in the safe closed configuration.

This problem is solved and these objects are achieved by the present invention by means of a clamp device made in accordance with the following claims.

BRIEF DESCRIPTION OF THE DRAWINGS

The characteristics and advantages of the invention will be more fully apparent from the detailed description of a preferred example of embodiment thereof, illustrated, for guidance and in a non-limiting way, with reference to the attached drawings, in which.

PREFERRED EMBODIMENT OF THE INVENTION

Figure 1:
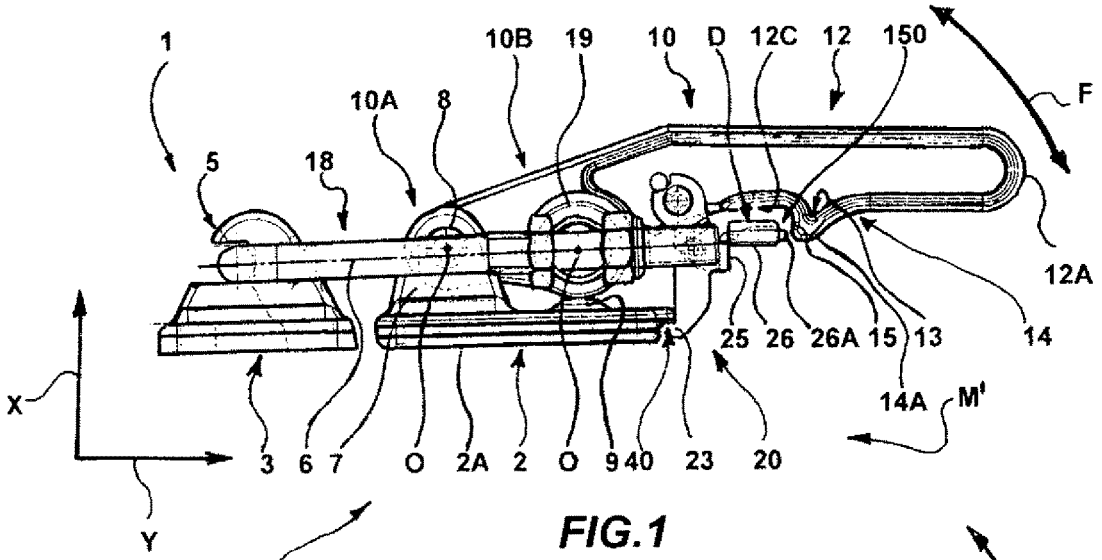
FIGS. 1 to 3 are side views, in partial cross section, of a clamp device according to the present invention in various operating configurations.

With initial reference to FIGS. 1 to 4, a clamp device 1 of the toggle type made according to the present invention is shown.

The clamp device 1 comprises a base 2 and a second base portion 3, which can be respectively fastened, for example, to a first and a second part, not shown in the drawings, of a container to be closed with the clamp device 1 of the invention, and a handle 10 rotatably hinged on the base 2 and arranged to be grasped by an operator to move the clamp device 1.

In the embodiment shown, the base 2 and the second base portion 3 are positioned virtually on the same plane, and are spaced apart from one another along a transverse direction X; however, in versions which are not shown they may be positioned virtually perpendicularly to one another.

The second base portion 3 is shaped so as to define, on the opposite side from the base 2, a C-shaped seat 5 for housing a hooking element of the clamp device 1, as explained more fully below.

The base 2 is rectangular in shape, being delimited by two transverse edges 2A and longitudinal edges 2B, and is provided with two side walls 7 extending in a vertical direction Y which is perpendicular, in a Cartesian reference frame, to the transverse direction X, these walls being designed for the hinged connection of the handle 10, and with a projection 9 extending in the direction Y and adapted to form an end stop element for the handle 10.

The base 2 is provided, on a longitudinal edge 2B positioned on the opposite side from the second base portion 3, with a recess 40 adapted to form the housing seat for a catch element of the clamp device 1, for locking the clamp device in the closed configuration W, as described more fully below.

The handle 10 comprises a pivot portion 10A arranged to be inserted between the two side walls 7 and provided with a hole into which the pivot pin 8 is inserted. Thus the handle 10 is hinged to the base 2 so as to be rotatable in both directions of the arrow F, to move the clamp device 1 between a closed configuration W shown in FIGS. 1, 2 and 4 and a plurality of open configurations, one of which is the open configuration Z shown in FIG. 3.

The handle 10 further comprises a handgrip portion 12 formed on the opposite end from the pivot portion 10A and adapted to be grasped by an operator for opening and/or closing the clamp device 1.

The handgrip 12 has a predominantly longitudinal extension along an axis "L" and comprises a spur 13 extending from a longitudinal face 12C of the handgrip 12 facing the base 2, in a direction transverse to the longitudinal axis L, so that, when the clamp device 1 is in the closed configuration W, the spur 13 faces towards the first base portion 2. The spur 13 is arranged to facilitate the gripping and actuation of the handgrip 12 and to improve the safety of the locking device 1 for an operator, as described more fully below. The spur 13 is beak-like shaped and has a substantially triangular shape, with a wall 14 projecting from the handgrip 12 in a direction transverse to the longitudinal axis L away from the end 12A of the handgrip towards the base 2.

Preferably, the wall 14 is inclined at an angle $\alpha$ of less than 90° to the longitudinal axis L. The spur 13 further comprises a second wall 15 extending from the handgrip 12 to the free end 14A of the wall 14 in a direction transverse to the longitudinal axis L of the handgrip 12, facing the pivot portion 10A of the handle 10.

Thus the dimensions of the spur increase with distance from the end 12A. In one version, the second wall 15 is substantially perpendicular to the longitudinal axis L.

The dimensions of the spur 13 and/or the inclination and extension of the wall 14 are chosen according to the dimensions of the clamp device 1.

The wall 14 is shaped so as to facilitate the gripping of the handgrip 12 by the operator, and to form the portion for supporting the operator's finger during the actuation of the locking device 1.

In use, the operator, while grasping the handgrip 12 with the fingers of one hand, can make one finger bear on the wall 14 of the spur 13, while the other fingers of the same hand extend around the handgrip 12 to grasp it firmly. Thus the operator can exert leverage on the wall 14 to actuate the locking device 1, thereby increasing the ease of actuation of the device itself.

The presence of the spur 13 is particularly advantageous in large devices, since it facilitates their operation; this is because the operator, by making one finger bear on the wall 14 of the spur, exerts leverage on this wall to move the handle 10.

In a preferred version, the wall 14 is concave to facilitate the housing of the operator's finger, the concavity facing towards the end portion 12A of the handgrip 12.

Advantageously, the wall 14 is shaped so as to house the thumb of one of the operator's hands, while the other fingers are extended around the handgrip 12 and bear on the longitudinal face 12C of the handgrip, so that the operator can exert leverage with his thumb during the actuation of the clamp device 1.

The handgrip 12 may be made of plastic material or may be formed by a metal body coated in plastic material, to facilitate gripping and manoeuvring by an operator.

The clamp device 1 further comprises a closing device 18 hinged at a second pivot pin 19 to the handle 10, in an intermediate portion 10B of the handle interposed between the pivot portion 10A and the handgrip 12.

The closing device 18, of a known type, is designed to interact with the second base portion 3 to close the clamp device 1, and, in the illustrated version, comprises a hook 6 designed to be housed in the housing seat 5 of the second base portion 3.

The pivot pin 8 and the second pivot pin 19 are positioned so that their respective centres of rotation O, O' are spaced apart by a distance D, the value of which depends on the overall dimensions of the clamp device 1, the shape of the closing device 18, and/or the housing seat 5.

The rotation of the handle 10 about the pivot pin 8 causes the second pivot pin 19 to move along an arc of circumference having a radius equal to the distance D.

The projection 9 of the first base portion 2 forms the bearing surface for the handle 10 in the closed configuration W, and is shaped so that, in this configuration, the centres of rotation O, O' of the pivot pin 8 and the second pivot pin 19 and the hook 6 are aligned with one another, or, as in the illustrated version, the pivot pin 8 and the hook 6 are aligned with one another and the second pin 19 is positioned at a shorter distance from the base 2A than the first pivot pin 8.

This enables the closed configuration W of the clamp device 1 to be made stable, preventing any movement of the hook 6 from the housing seat 5 in the second base portion 3, that is to say any accidental release of the clamp device 1.

The clamp device 1 further comprises a locking device 20 for locking the clamp device 1 in the closed configuration W, thus further increasing its safety.

The locking device 20 is hinged on a hinge pin 22 interposed between the second pivot pin 19 and the handgrip 12 of the handle 10, so as to be rotatable relative to the handle in both directions of the arrow F1, as explained more fully below.

The locking device 20 comprises, in the illustrated version, two catch arms 21 each having a first end 21A provided with a hinge head 29 in which a hole 29A is formed for housing the hinge pin 22, and an opposed second end 21B provided with a catch element 23 adapted to interact with the first base portion 2 to lock the clamp device 1, as shown in FIG. 1.

In the illustrated version, the catch element 23 is shaped as a tooth projecting from the catch arms 21 and adapted to be inserted into the recess 40 to lock the clamp device 1. The tooth 23 comprises a catch wall 23A adapted to engage with the wall of the recess 40 and a curved wall 23B extending from the catch wall 23A and having its concavity facing the handgrip 12, that is to say being convex towards the base 2.

The curved wall 23B comprises an apex 23C forming the nearest point to the base 2 of the tooth 23, from which there extends a first wall portion 23D, interposed between the apex 23C and the catch wall 23A, and an opposed further portion 23E.

The two portions 23D, 23E have a practically symmetrical curvature about the apex 23C with respect to the vertical axis Y.

The locking device 20 further comprises a gripping portion 26 extending from the catch arms 21 towards the handgrip 12, with its free edge 26A facing the second wall 15, this portion being designed to be grasped by the operator to rotate the locking device 20.

In the version of FIGS. 1 to 4, the gripping portion 26 and the catch element 23 are positioned on the same side of the handgrip 12, that is to say on the side of the handgrip facing the base 2, and can be moved, as explained more fully below, in the space between the handgrip and the base 2.

The gripping portion 26 and the spur 13 are provided on the same side of the handgrip 12, and therefore an operator can press on the spur 13 with some of the fingers of one hand and actuate the locking device 20 with another finger of the same hand.

The gripping portion 26 can be moved in the area identified between the handle 10 and the base 2, and comprises a metal body, at least partially coated in plastic material, to facilitate gripping by the operator.

In its movement, the gripping portion 26 moves while substantially facing the second wall 15, a gap 150 with dimensions of the order of millimetres being formed between the free edge 26A of the gripping portion 26 and the second wall 15.

The size of the gap 150 prevents a user from accidentally inserting his fingers between the gripping portion 26 and the spur 13.

Figure 2:
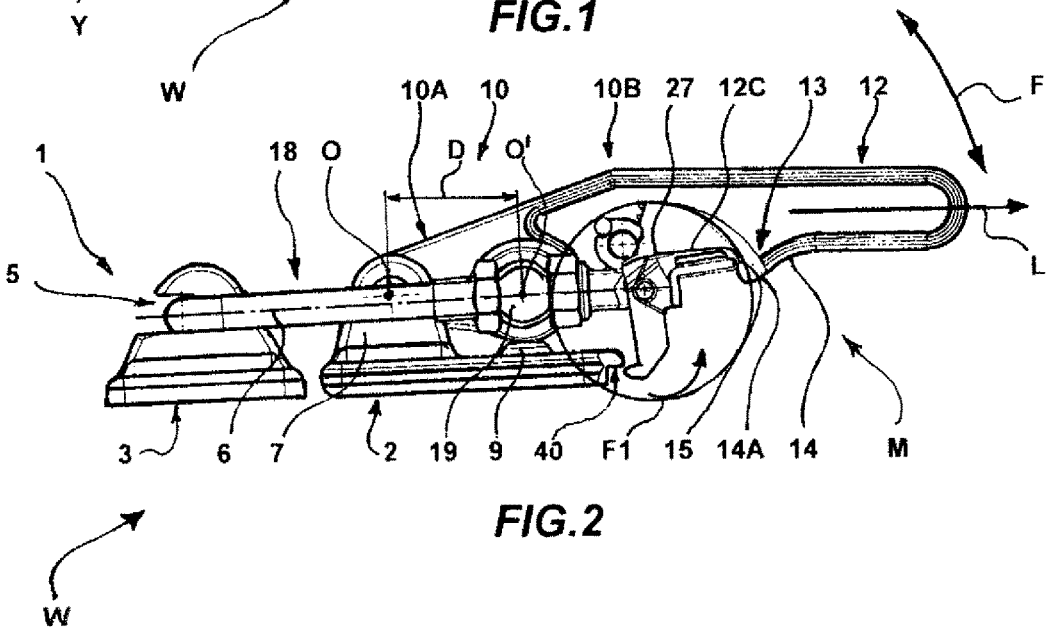
Figure 2A:
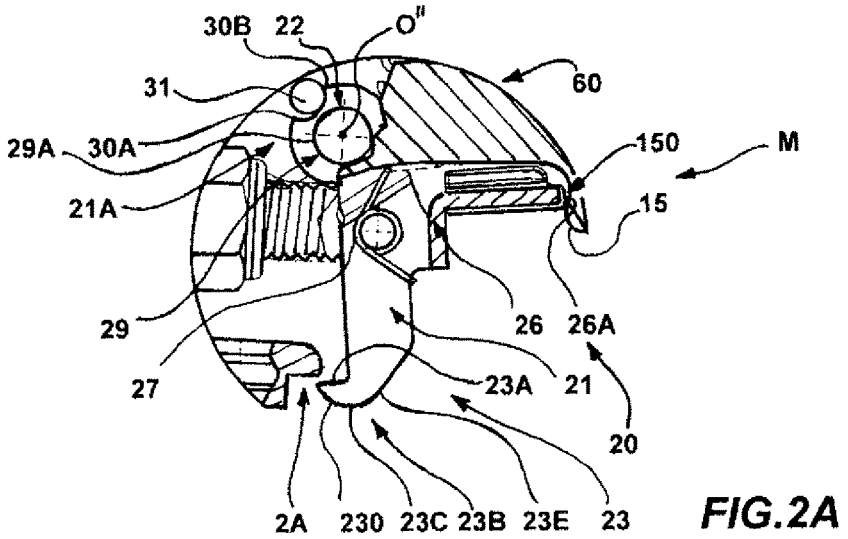
FIGS. 2A and 3A are enlarged views of the detail A of FIGS. 2 and 3.
Figure 3:
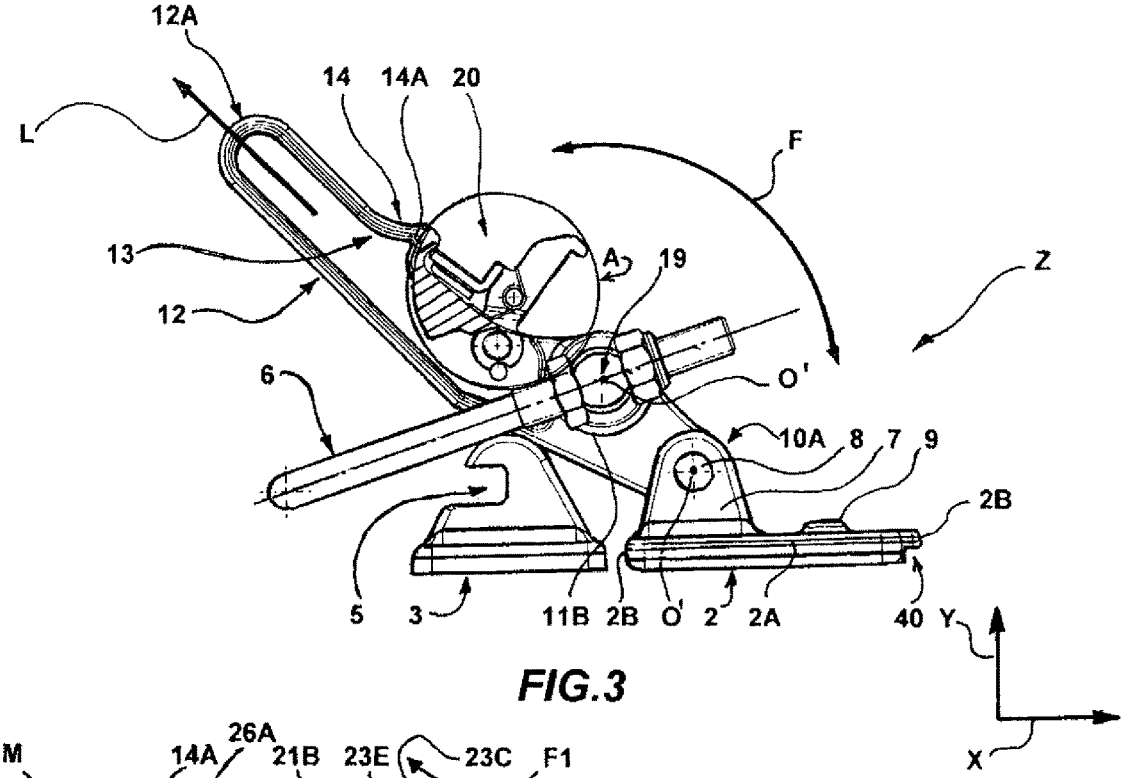
Figure 3A:
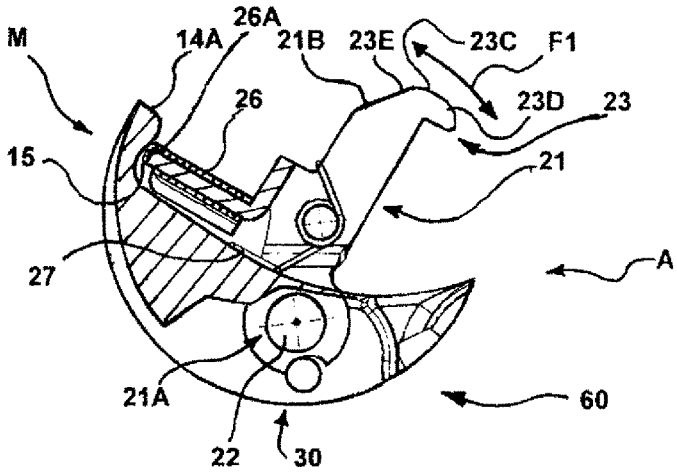

The locking device 20 is rotatable about a hinge pin 22 between a release position M shown in FIGS. 2 and 3, in which the gripping portion 26 is adjacent to or bearing on the longitudinal face 12C of the handgrip 12, and a locking position M' shown in FIG. 1, in which the gripping portion 26 is spaced apart from the face 12C and substantially aligned with this face, and, with the clamp device in the closed configuration W, the catch element 23 is inserted into the recess 40.

In the actuation of the locking device 20, the gripping portion 26 slides while substantially facing a second wall 15 of the spur 13.

In one version, in the locking position M', the free edge 26A of the gripping portion 26 is located at the free edge 14A of the wall 14.

In the locking position M', the gripping portion 26 is placed at the maximum distance from the handgrip 12, and a space "D" whose size increases with distance from the hinge pin 22, that is to say with proximity to the end part 12A of the handgrip 12 and to the second wall 15, is formed between the handgrip and the gripping portion 26.

The spur 13 is positioned so as to block access to the space "D" having greater dimensions, that is to say the space through which it is easier for an operator to accidentally insert a finger.

The locking device 20 comprises a spring 27, or other pushing element, so configured as to push the locking device 20 into the locking position M'.

In the illustrated version, the spring 27 has its opposite ends attached, respectively, to the handle 10 and to a catch arm 21.

The locking device 20 further comprises a stroke limiting means 60 to limit the stroke of rotation of the locking device 20 about the hinge pin 22, to increase the safety of the use of the clamp device 1.

The stroke limiting means 60 are integral with the locking device 20, so that the movement of the locking device 20 can be limited in any configuration of the clamp device 1.

In a version which is not shown, the spring 27 is configured to act as a stroke limiting means of the locking device 20.

In the illustrated version, the stroke limiting means 60 comprise a cut-out 30 formed on the peripheral portion of each hinge head 29 and intended to house a raised part 31 provided on the handle 10, in such a way that, in the rotation of the locking device 20, the cut-out 30 slides relative to the raised part 31.

The cut-out 30 and the raised part 31 form guide means for the rotation of the locking device 20, and act as stroke limiting means 60 to limit the rotation of the locking device 20 relative to the handgrip 12. In the release position M and the locking position M', the first and second ends 30A, 30B of the cut-out 30, respectively, bear against the raised part 31, and further rotation is prevented by the shape of the cut-out 30 and the raised part 31.

The cut-out 30 and the raised part 31 are designed to allow the locking device 20 to rotate through about 2.5°-15°, or preferably about 5°-10°.

The presence of the stroke limiting means 60 makes it possible to adjust the extent of the rotation of the locking device about its hinge pin, and therefore makes the actuation of the clamp device of the invention more precise, as well as safer.

By varying the size of the cut-out 30 and the raised part 31, the extent of the rotation of the locking device 20 can be varied.

The presence of the pushing element makes it possible to increase the safety of the use of the clamp device according to the invention, since, when the clamp device is in the correct position, the catch element 23 is automatically pushed into the locking position. Because of the presence of the stroke limiting means 60, it is possible to prevent the locking device 20 from rotating excessively relative to the handgrip 12 and possibly be jammed against parts of the clamp device, thus avoiding the need for the operator to intervene manually to disengage the locking device during the closing and/or opening of the clamp device 1.

Additionally, since the stroke limiting means are integral with the locking device, this adjustment action is performed in any position of the clamp device, regardless of the relative positioning of the clamp device and the base.

Moreover, this also enables the stroke of the locking device to be adjusted with excellent precision, regardless of any irregularities of positioning of the base.

Because of the presence of the stroke limiting means 60, it is possible to prevent the gripping portion 26 from moving excessively far from the face 12C of the handgrip 12, and consequently to prevent the formation of a space "D" having dimensions such that an operator could accidentally insert a finger into it.

This enables safety to be improved for an operator of the clamp device 1 of the invention.

This effect is increased by the presence of the spur 13 which is placed on the same side of the handgrip 12 as the gripping portion 26, and which is shaped to block any possible access of the operator's finger at the end part 12A of the handgrip 12.

The stroke limiting means 60 can also facilitate the operations of closing the clamp device 1, since they prevent the catch element 23 from rotating away from the handgrip 12 until the second portion of wall 23E comes to bear against the longitudinal edge 2B. The stroke limiting means 60 enable the catch element 23 to rotate in such a way that it strikes the longitudinal wall 2B in the first portion 23D.

The shape of the first portion 23D makes it possible to guide the insertion of the catch tooth 23 into the recess 40: when the handgrip 12 is lowered, the first portion 23D slides along the longitudinal wall 2B until the tooth 23 is inserted into the recess 40. Conversely, if the tooth 23 were to strike the longitudinal wall with its apex 23C or with its second portion 23E, this sliding would be impeded, and the operator would have to act on the locking device 20 to move it to the release position M in order to close the clamp device 1.

The first wall portion 23D and the longitudinal wall 2B are shaped relative to one another so as to allow one to slide along the other and prevent jamming.

This enables the clamp device 1 to be closed automatically without any action on the locking device 20.

In operation, when the clamp device 1 is in an open configuration Z, in order to attach two parts of a container, the operator grasp the handgrip 12 and rotates the handle 10 in the direction F, towards the base 2, first bringing the hook 6 to the seat 5 and then inserting it into the seat.

During the closing of the clamp device 1, the locking device 20 is pushed by the spring into the locking configuration, this rotation being limited by the stroke limiting means 60, and the second end 30B of the cut-out 30 is brought to bear against the raised part 31, any further rotation being impeded by the wall of the cut-out.

When the handgrip 12 is brought towards the base 2, the catch element 23 comes to bear with its first wall portion 23D against the longitudinal wall 2B of the first base portion 2, and slides along the longitudinal wall 2B; as the pushing of the handgrip 12 continues, to bring the clamp device 1 into the closed configuration W, the first wall portion 23D slides along the longitudinal wall 2B until the tooth 23 is inserted into the recess 40.

During the sliding of the catch element 23, the longitudinal wall 2B exerts a thrust on the catch element 23 facing in the opposite direction to the force exerted by the spring 27. When the catch element 23 is positioned in the recess 40, with the clamp device 1 in the closed configuration W, the spring 27 pushes the locking device into the locking position M' and the clamp device 1 is stably locked in the closed configuration W.

To open the clamp device 1, an operator must first act on the gripping portion 26 to bring it towards the face 12C, so as to bring the locking device 20 into the release position M in order to extract the catch element 23 from the recess 40; then, keeping the locking device 20 in the release position M, he must rotate the handle 10 away from the base 2, subsequently releasing the hook 6 from the seat 5.

In this movement, the operator may continue to exert a pressure on the gripping portion 26, keeping the locking device 20 in the release position M, or may remove his fingers from the gripping portion 26. In the latter case, the spring 27 returns the catch device 20 to the locking position M', but if the catch element 23 is not positioned in the recess 40 it cannot be re-inserted into the recess 40, but is made to bear against the edge of the longitudinal wall 2B.

In this case also, the presence of the stroke limiting means prevents excessive rotation of the locking device 20, which would cause it to impede the movement of the clamp device 1.

The locking device 20 rotates from the release position M until the raised part 31 is made to bear on the first end 30A of the cut-out 30, further rotation being prevented by the shape of the cut-out 30 and of the raised part 31.

The stroke limiting means 60 are designed to allow rotation through about 2.5°-15°, or preferably about 5°-10°.

This rotation is sufficient to enable the catch element 23 to be extracted from the recess 40, while sufficiently limiting the size of the space formed between the gripping portion 26 and the handgrip 12 and preventing jamming of the locking device 20.

The actual extent of the rotation allowed to the locking device 20 is chosen on the basis of the dimensions of the clamp device 1.

Additionally, the spring 27 and the stroke limiting means 60 make it unnecessary for the operator to act on the locking device 20 to move it during the closing of the clamp device 1.

The spring automatically brings the locking device 20 into the locking position M', and then, when the catch element 23 is in the recess 40, the catch element 23 is inserted automatically into the latter, the stroke limiting means 60 limit the rotation of the catch element 23 under the pressure of the spring 27 so as to bring the first wall portion 23D to the longitudinal wall 2B, preventing blockage or jamming.

Conversely, in order to release the clamp device 1 from the closed configuration W, the locking device 20 must be actuated to bring it to the release position M, overcoming the force exerted by the spring 27, until the catch element 23 is no longer in area of the recess 40. Consequently, the safety of the use of the clamp device 1 of the invention is further improved.

The stroke limiting means, which limit the rotation of the locking device, prevent excessive rotation of the device in this case also.

The position and configuration of the gripping portion 26 makes the use of the device of the invention particularly convenient, since the locking device 20 can easily be actuated by the same hand as that used to actuate the handgrip 12.

Moreover, the opening and closing of the clamp device 1, and the release and locking of the locking device 20 are also performed by the operator using only one hand.

In some versions, especially in devices of limited size, the spur 13 may be omitted.

With reference to FIGS. 5 to 8, these show a second embodiment of a clamp device 1' made according to the invention. Parts corresponding to the parts of the embodiment described above are indicated by the same reference numerals, with the addition of a prime, and will not be described in detail, for the sake of brevity.

The handle 10' is hinged to the base 2' by means of a lever 4' pivoted on a hinge pin 8' and a hook 6' hinged to the handle and to the base 2'.

The base 2', the pivoting lever 4', the handle 10' and the hooking element 6' form a four bar linkage with two fixed pivot pins, both formed on the base, and two movable rotation pins, formed, respectively, between the handle 10' and the pivoting lever 4' and between the handle 10' and the hooking element 6'.

The base 2' comprises a rectangular body from which there project two side walls 7', between which the two fixed pivot pins extend, each wall being provided on one of its edges 7'A, positioned on the opposite side from the coupling element 6', with a recess 40' adapted to form the housing seat for the catch element 23' of the locking device 20'. The handle 10' is fork-shaped, with a central body 11' covered with the handgrip 12' made of plastic material to facilitate its gripping and actuation by an operator, and two branches 50', 50'A extending from the central body 11', the hooking element 6' being hinged to the opposite longitudinal end 11'A of the body from the handgrip 12'.

The pivoting lever 4' is hinged to the metal body 11' in an intermediate position between the first end 11'A and the handgrip 12'.

The handgrip 12' is provided with a spur 13' which is designed to improve safety for an operator and facilitate the actuation of the clamp device 1', in a similar manner to that described above.

The hinge pin 22' for the locking device 20' extends between the two branches 50', 50'A of the fork, and the hinge heads 29' of the two catch arms 21' are pivoted on the inner walls of the two branches 50, 51 of the fork.

On each of the inner walls of the two branches 50', 50'A of the fork there is also formed a raised part 31' designed to form, together with the cut-out 30' defined by the hinge heads 29', guide means for the rotation of the locking device 20', and stroke limiting means 60' to limit the rotation of the locking device 20' relative to the handgrip 12'.

In this case also, in the release position M and the locking position M' of the locking device 20', the raised part 31' bears, respectively, against the two opposite ends 30'A, 30'B of the cut-out 30', and the slot 30' and the raised part 31' are designed to allow the locking device 20' to rotate through about 2.5°-15°, or preferably about 5°-10°. Therefore, in this case also, the stroke limiting means can be used to adjust the extent of the rotation of the locking device.

The operation of the locking device 20' is similar to that discussed above and therefore will not be described in detail.

The catch element 23' and the walls 7' are shaped so as to allow their sliding relative to one another in the closing of the clamp device 1', and to prevent the catch element 23' from jamming on the edge 7'A of the wall 7', while instead enabling it to be guided in its insertion into the recess 40'.

Advantageously, the first wall portion 23'D of the catch element 23' facing the base 2' is rounded so as to promote the sliding of the catch element 23' and the edge 7'A of the wall 7' relative to one another, and to prevent jamming.

The spring 27' is designed to push the locking device 20' into the locking position M', in such a way that, when the catch element 23' is positioned in the recess 40', the locking device 20' automatically locks the clamp device 1' in the closed position W.

In this embodiment also, the presence of the spur 13' makes it possible to improve the safety and ease of using the clamp device of the invention.

The advantages discussed with reference to the previously described embodiment are therefore retained.

Figure 9:
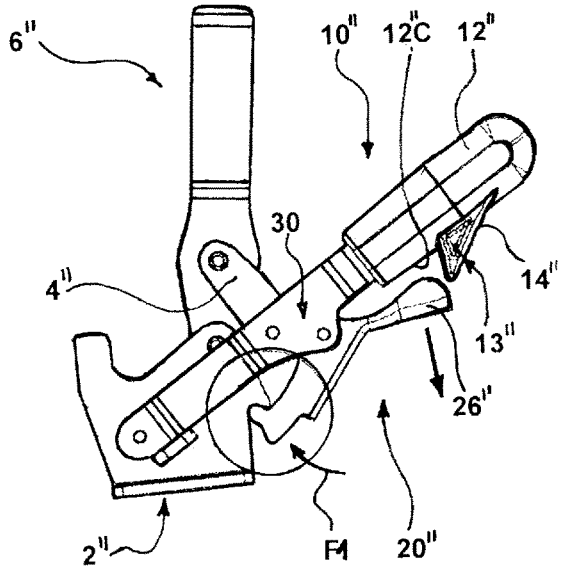
FIGS. 9 to 11 are side views, in partial cross section, of a third embodiment of a clamp device according to the present invention, in different operating configurations.
Figure 9A:
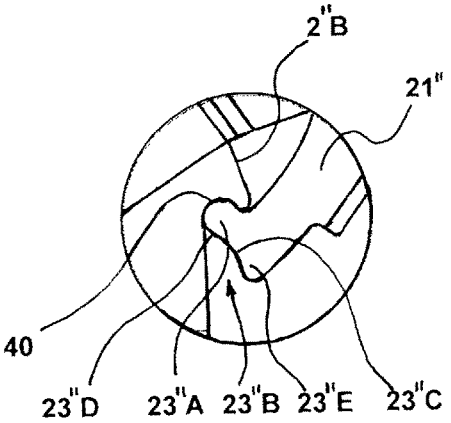
FIGS. 9A and 10A are enlarged views of the detail A of FIGS. 9 and 10 respectively.
Figure 10:
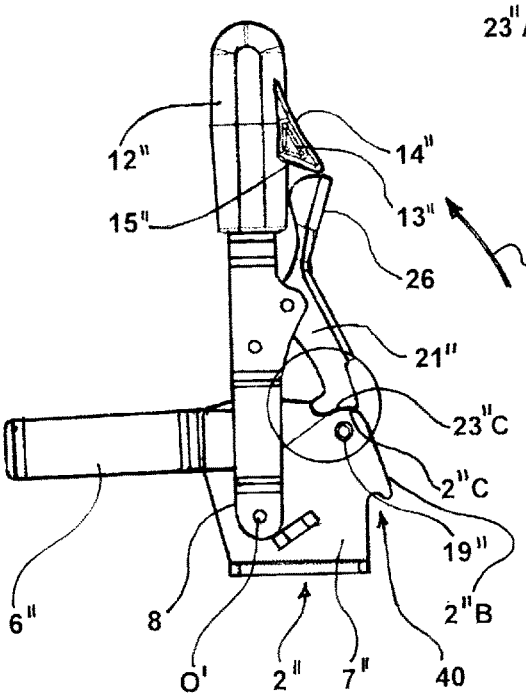
Figure 10A:
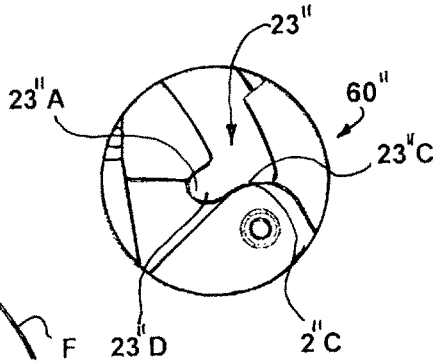
Figure 11:
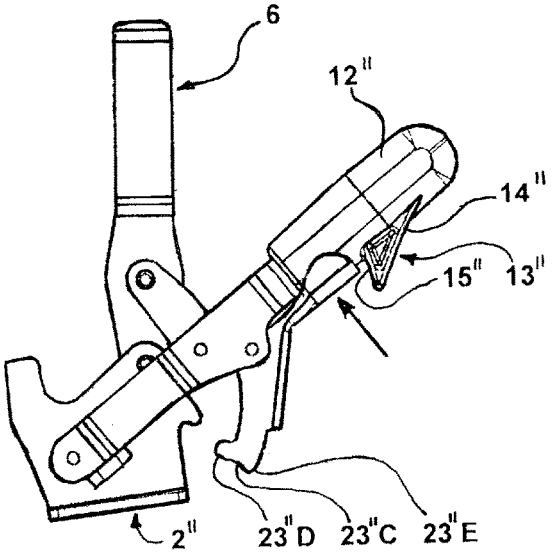

With reference to FIGS. 9 to 11, these show a third embodiment of the clamp device 1" made according to the invention. Parts corresponding to the parts of the embodiment described above are indicated by the same reference numerals, and will not be described in detail, for the sake of brevity.

The clamp device 1" comprises a base 2", a handle 10" designed to be taken hold of by an operator to move the clamp device 1" hinged to the base portion 2" by means of a lever 4" pivoted on a hinge pin 8" and a hook 6" hinged to the handle 10" and to the base 2".

The handle 10" and the hook 6" are hinged to the base 2", in such a way that, when the handle 10" is rotated, the hooking element 6" is also moved.

The base 2" comprises a rectangular body from which there project two side walls 7", between which the two fixed pivot pins extend, each wall being provided on one of its edges 7"B, positioned on the opposite side from the hooking element 6", with a recess 40" adapted to form the housing seat for the catch element 23" of the locking device 20".

The handle 10" is fork-shaped, with a central body 11" covered with the handgrip 12" made of plastic material to facilitate its gripping and actuation by an operator, and two branches 50", 50"A extending from the central body 11", which are hinged to the base 2" at their opposite longitudinal ends 11"A from the handgrip 12".

The handgrip 12" is provided with a spur 13" which is designed, in a similar manner to that described above, to improve safety for an operator of the clamp device 1", which projects from the face 12"C of the handgrip 12" facing the base 2". The gripping portion 26" is provided on the same side of the handgrip as the spur, so that an operator can use the same hand to take hold of the handgrip 12", while pressing one or more fingers on the spur 13" and actuating the gripping portion 26".

The locking device 20" is pivoted on a hinge pin 22" extending between the inner walls of the two branches 50", 51" of the fork in hinge portions 29", and is provided with stroke limiting means 60" to limit its rotation relative to the handgrip 12".

The stroke limiting means 60" comprise, in the illustrated version, a return spring 61" extending between the two catch arms 21" at the position of the hinge pin 22" and configured to act as an end stop for the locking device 20".

In this version, the stroke limiting means may also include a slot formed in the hinge pin and interacting with a pin to limit the rotation of the locking device.

In this version, the catch element 23" comprises a catch wall 23"A adapted to engage with the wall of the recess 40" and a curved wall 23"B extending from the catch wall 23"A and having its concavity facing the base 2, that is to say being convex towards the handgrip 12.

The curved wall 23"B comprises an inner apex 23"C forming the point of greatest re-entry of the curved wall 23"B, from which there extends a first wall portion 23"D, interposed between the apex 23"C and the catch wall 23"A, and an opposed further portion 23"E.

The two portions 23"D, 23"E have a practically symmetrical curvature with respect to the apex 23"C.

The curved wall 23"B is shaped to be coupled with a positive connection to the longitudinal edge 7"B of the base, so as to facilitate the sliding of the catch element 23" along the longitudinal wall.

The presence of the stroke limiting means 60" prevents the catch element 23" from rotating excessively relative to the handgrip 12" and striking the longitudinal edge 7"B with the second wall portion 23"E and thus becoming jammed on the longitudinal edge 7"B.

The locking device 20" is equipped with pushing means configured so as to push the locking device 20" into the locking position M', in such a way that the clamp device 1" is automatically locked in the closed configuration W and in the open configuration Z, the latter configuration being shown in FIG. 10.

The pushing means, configured for example as a spring, push the two catch arms 21" into the open configuration Z at the position of the apex 23"C on an apex portion 2"C of the base, as shown in FIG. 10, preventing any further movement of the clamp device 1" in an opening or a closing direction.

The apex 23"C and the apex portion 2"C of the base 2" are configured to be coupled to one another by a positive connection, and form locking means for the clamp device 1" adapted to lock the clamp device in the open configuration Z.

In order to move the clamp device from the open configuration Z, the operator must act on the locking device 20 to detach the catch element 23" from the base 2" in opposition to the pushing force exerted by the spring.

Other configurations of the locking means, different from those shown, may be provided for locking the locking device 1" with respect to the base 2".

The pushing means also push the clamp device 1" in such a way that, in the closing step, the two catch arms 21" strike the longitudinal edge 2"B of the base 2" with the catch wall 23"A. Thus, when the handle 10" is rotated towards the base 2", the catch wall 23"A slides on the longitudinal edge 2"B until it is inserted into the recess 40" and locked therein.

The locking device 20" is then automatically locked in the closed configuration.

The configuration of the catch element and the presence of the pushing means enable the clamp device 1" to be locked in the open configuration, so that the operator must act on the locking device 20" in order to move the clamp device from the locked open configuration Z. This characteristic enables the safety of the use of the clamp device 1" to be increased.

Moreover, the clamp device 1" can be used in any vertical or horizontal position, since any undesired movements of the device, due to the weight of the handle 10 for example, are prevented.

The clamp device 1" can also be applied to equipment in an inverted position.

In this case, the clamp device 1", when opened, must remain in position, to avoid encumbering the working surface and to avoid injury to the operator.

Figure 12:
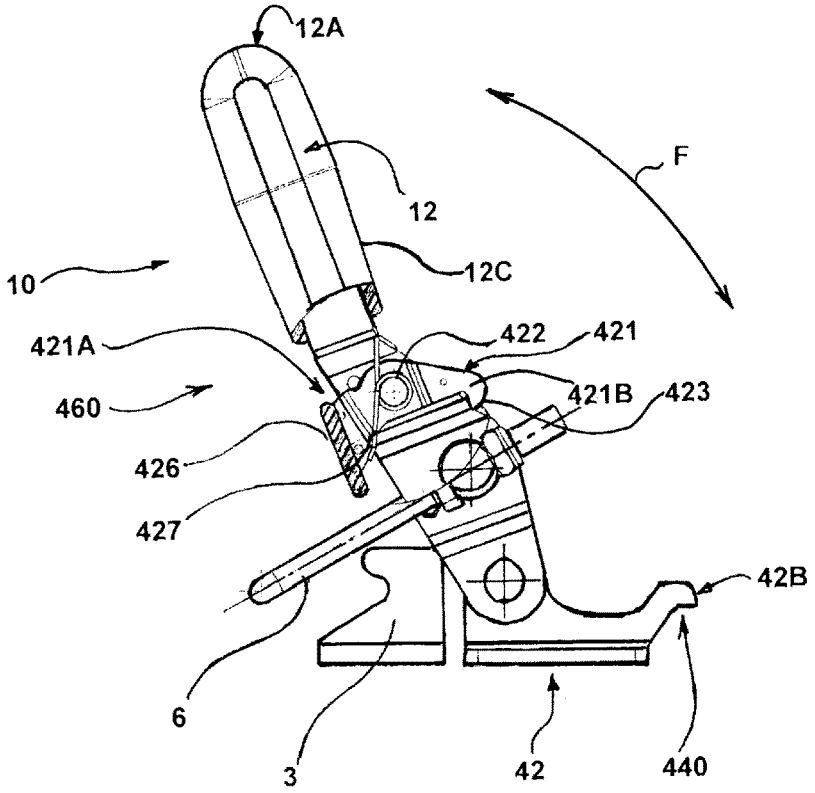
FIGS. 12 and 13 are side views, in partial cross section, of a fourth embodiment of a clamp device according to the present invention, in two different operating configurations.
Figure 13:
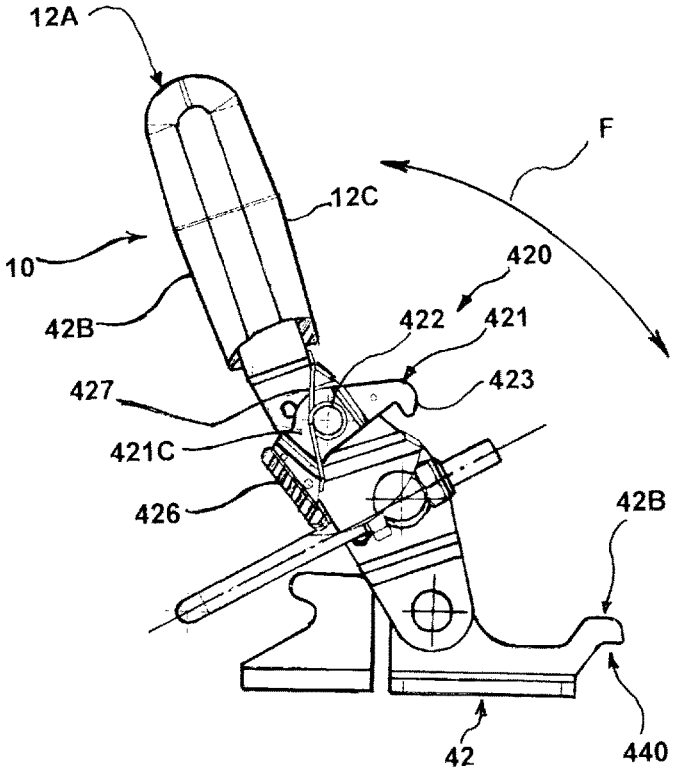

FIGS. 12 and 13 show a fourth embodiment of a clamp device 400 made according to the invention.

Figure 4:
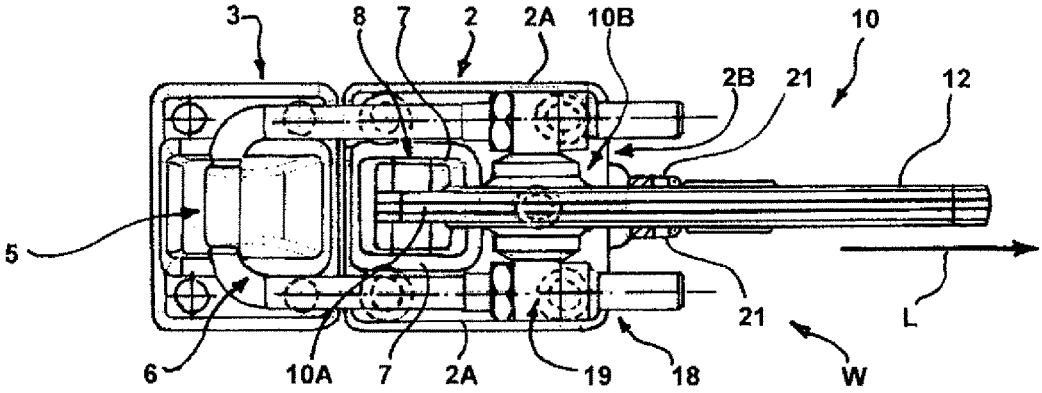
FIG. 4 is a view from above of the clamp device of FIG. 1.
Figure 5:
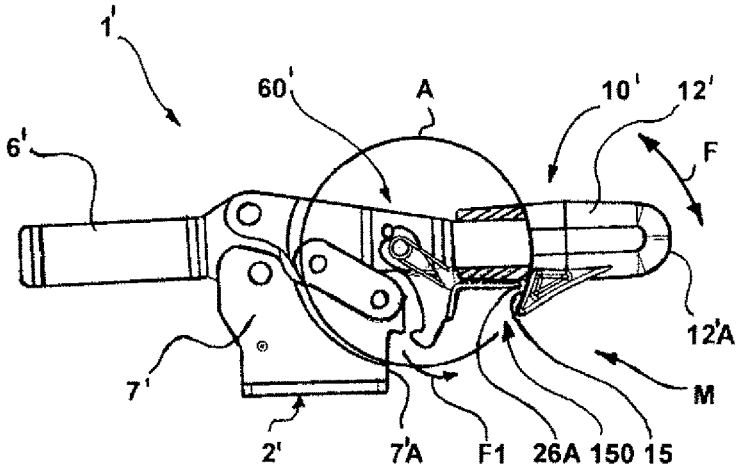
FIGS. 5 to 7 are side views, in partial cross section, of a second embodiment of a clamp device according to the present invention, shown in various operating configurations respectively.
Figure 5A:
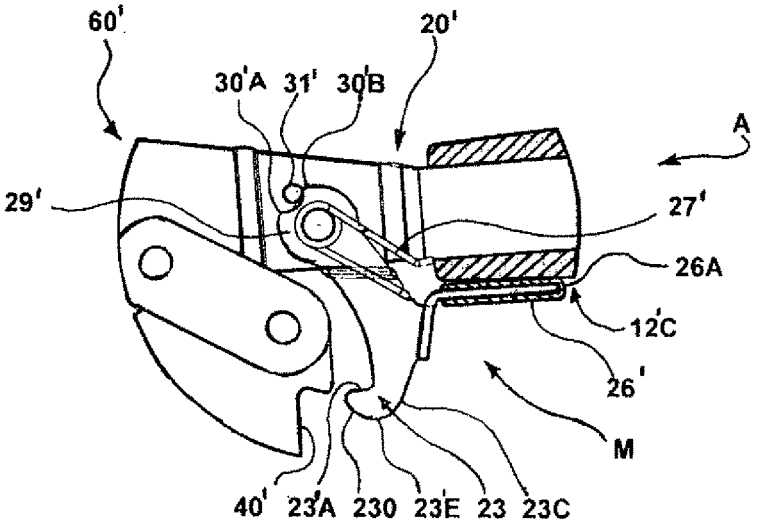
FIGS. 5A and 7A are enlarged views of the detail A of FIGS. 5 and 7 respectively.
Figure 6:
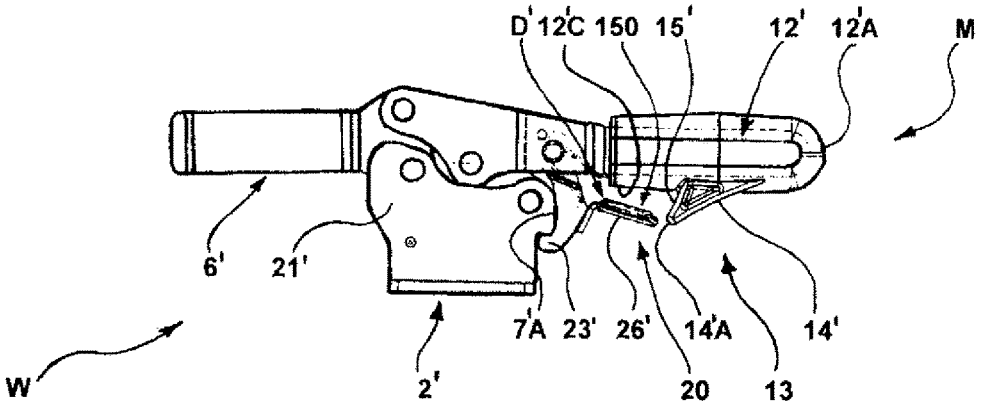
Figure 7:
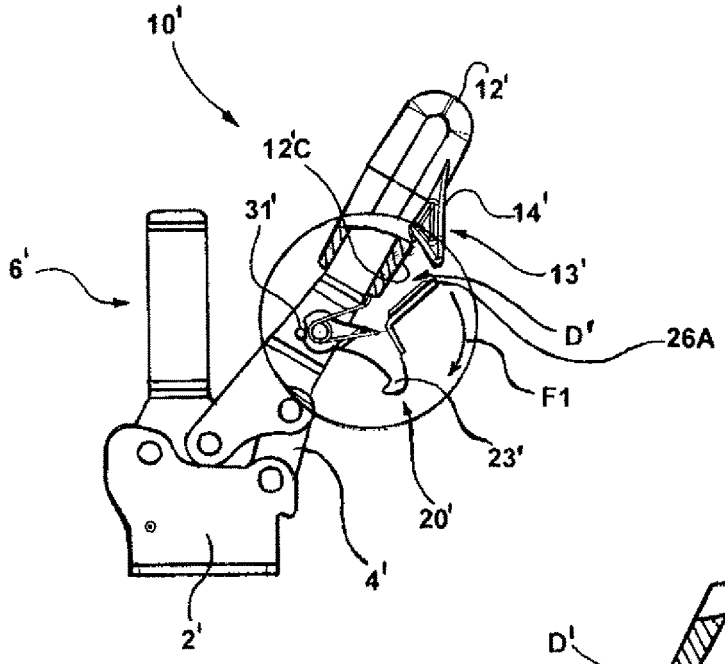
Figure 7A:
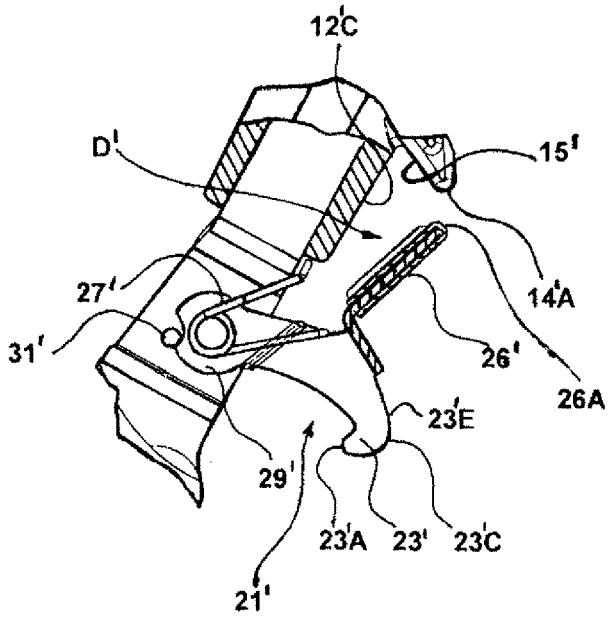
Figure 8:
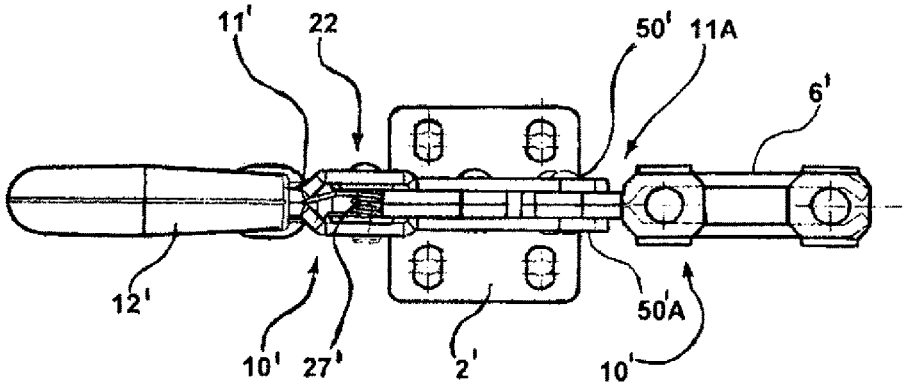
FIG. 8 is a view from above of the clamp device of FIG. 6.

This version is structurally very similar to the version shown in FIGS. 1 and 4, and identical parts are indicated by corresponding reference numerals; only the structural differences from the aforesaid version are described below, and reference should be made to the above description regarding the other characteristics.

The locking device 420 is hinged on the hinge pin 422 in an intermediate portion 421C of each of the two catch arms 421.

Each of the catch arms 421 is therefore equipped, at its first end 421A, with a gripping portion 426, and, at its opposed second end 421B, with a catch element 423 adapted to interact with the base 42 to lock the clamp device 400 as shown in FIG. 1.

The longitudinal edge 42B of the base 42 is equipped with a recess 440 for housing the catch element 423.

The gripping portion 426 and the catch tooth 423 are placed on opposite sides from one another relative to the longitudinal axis L of the handle 10.

The catch tooth 423 is shaped in a similar way to that discussed with reference to the versions of FIGS. 1 to 4, and will not be described in detail.

In this version, the spring 427, or other pushing element, configured so as to push the locking device 420 into the locking position M', also acts as an stroke limiting means 460 for limiting the rotation of the locking device 420 and preventing the catch tooth 423 from jamming on the base 42, instead of which it facilitates the automatic locking of the clamp device 400 in the closed configuration W.

The spring 427 is wound around the hinge pin 422 with its ends bearing, respectively, on the gripping portion 426 and on the handle 412, and is configured to limit the rotation of the locking device 420.

The gripping portion 426 comprises a metal body, at least partially coated in plastic material, to facilitate gripping by the operator.

The locking device 420 is rotatable about a hinge pin 422 between a release position M, not shown, in which the gripping portion 426 is adjacent to or bearing on the handle 410, and a locking position M' shown in FIGS. 12 and 13, in which the gripping portion 426 is spaced apart from the handle 410, and, with the clamp device in the closed configuration W, the catch element 423 is inserted into the recess 440.

Thus the advantages discussed with reference to the preceding versions are also retained in this version.

Figure 14:
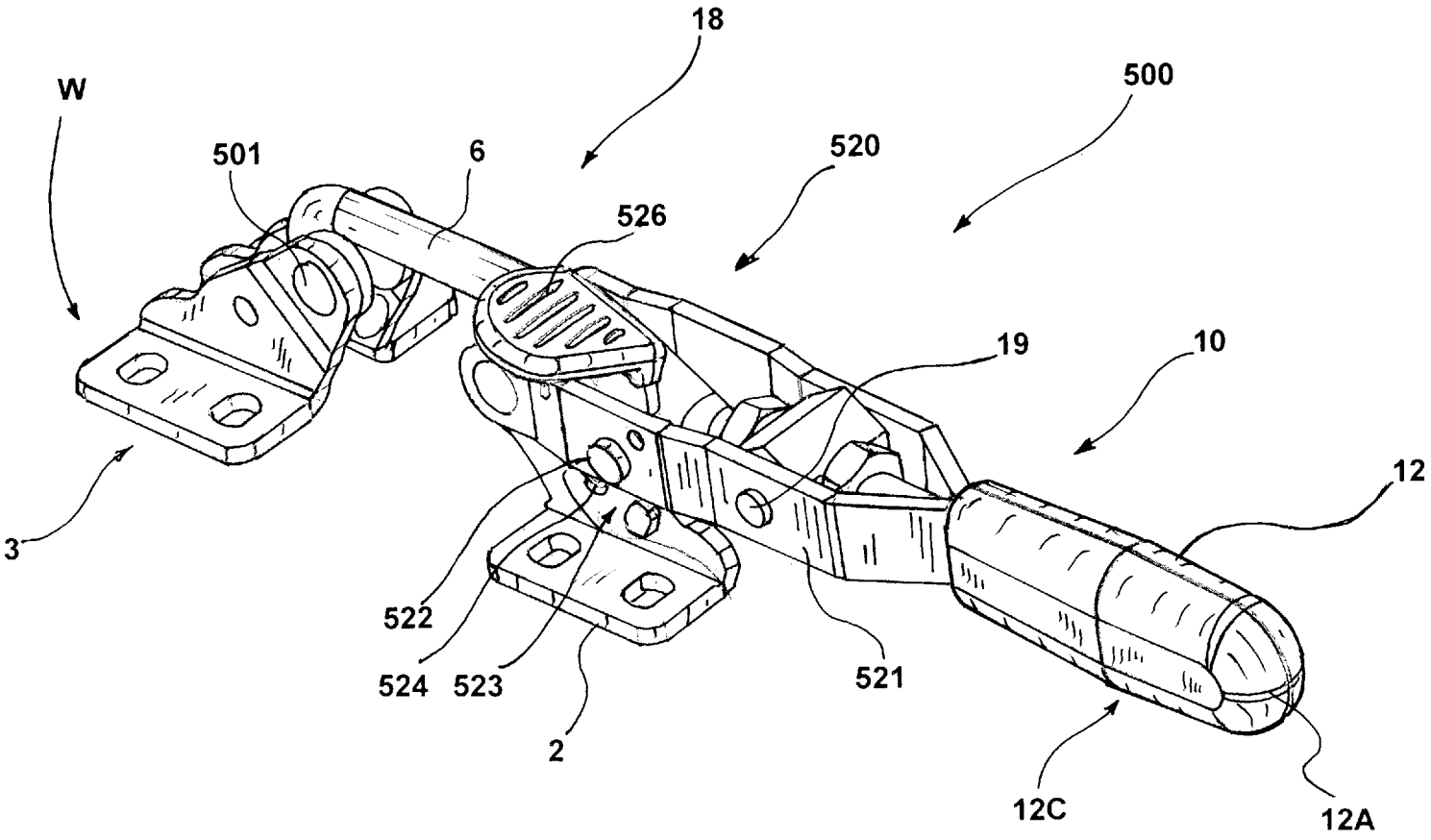
FIGS. 14 and 15 are, respectively, a perspective view and a side views of a fifth embodiment of a clamp device according to the present invention, in a closed configuration.

FIGS. 14 and -17 show a fifth embodiment of a clamp device 500 made according to the invention.

This version is structurally very similar to the version shown in FIGS. 1 and 4, and identical parts are indicated by corresponding reference numerals; only the structural differences from the aforesaid version are described below, and reference should be made to the above description regarding the other characteristics.

The handle 10 is hinged to the base 2 in a pivot portion 10A, within which there extends a pivot pin 8 provided in the base 2.

The closing device 18 is hinged at a second pivot pin 19 to the handle 10, in an intermediate portion 10B of the handle interposed between the pivot portion 10A and the handgrip 12.

The locking device 520 is hinged on a hinge pin 522 interposed between the second pivot pin 19 and the handgrip 12 of the handle 10, so as to be rotatable relative to the handle in both directions of the arrow F1.

The locking device 520 comprises, in the illustrated version, a catch body 521 equipped, at its first end, with a catch element 523 adapted to interact with the base 2 to lock the clamp device 500 as shown in FIG. 14, and, at its opposite, second end, with a gripping portion 526 adaptable to be actuated by a user to lock and/or unlock the locking device. The catch element 523 comprises a catch tooth forming a catch cavity 524 in which a catch pin 525 provided in the base 2 is securely housed.

The catch cavity 524 and the catch pin 525 are shaped so as to be coupled to one another by a positive connection.

The catch cavity 524 is also shaped so as to surround the catch pin 525 over a portion of circumference such that any undesired movement of the catch pin 525 out of the catch cavity 524 is prevented.

The gripping portion 526 is equipped with a knurled surface to facilitate gripping by a user's fingers.

When the grippable surface 526 is actuated, the locking device 520 is made to rotate around the hinge pin 522 so as to move the catch element in the direction of the arrow F5.

In this version, the gripping portion 526 and the catch element 523 are placed on opposite sides of the longitudinal axis L of the handgrip 12; that is to say, the catch element 523 faces the base 2.

The closing device 18, designed to interact with the second base portion 3 to close the clamp device 500, comprises a hook 6 designed to engage with a lock pin 501 provided in the second base portion 3.

The closing device 18 is hinged to the handle 10 at the second pivot pin 19, which is placed on the handle in a position interposed between the hinge pin 522 and the handgrip 12.

The gripping portion 526 and the catch tooth 523 are placed on opposite sides from one another relative to the longitudinal axis L of the handle 10.

In this version, the spring 527, or other pushing element, configured so as to push the locking device 520 into the locking position M', also acts as a stroke limiting means 560 for limiting the rotation of the locking device 520 and preventing undesirable jamming of the catch tooth 523.

On the contrary, it facilitates the automatic locking of the clamp device 500 in the closed configuration W.

The gripping portion 526 comprises a metal body, at least partially coated in plastic material, to facilitate gripping by the operator.

Figure 15:
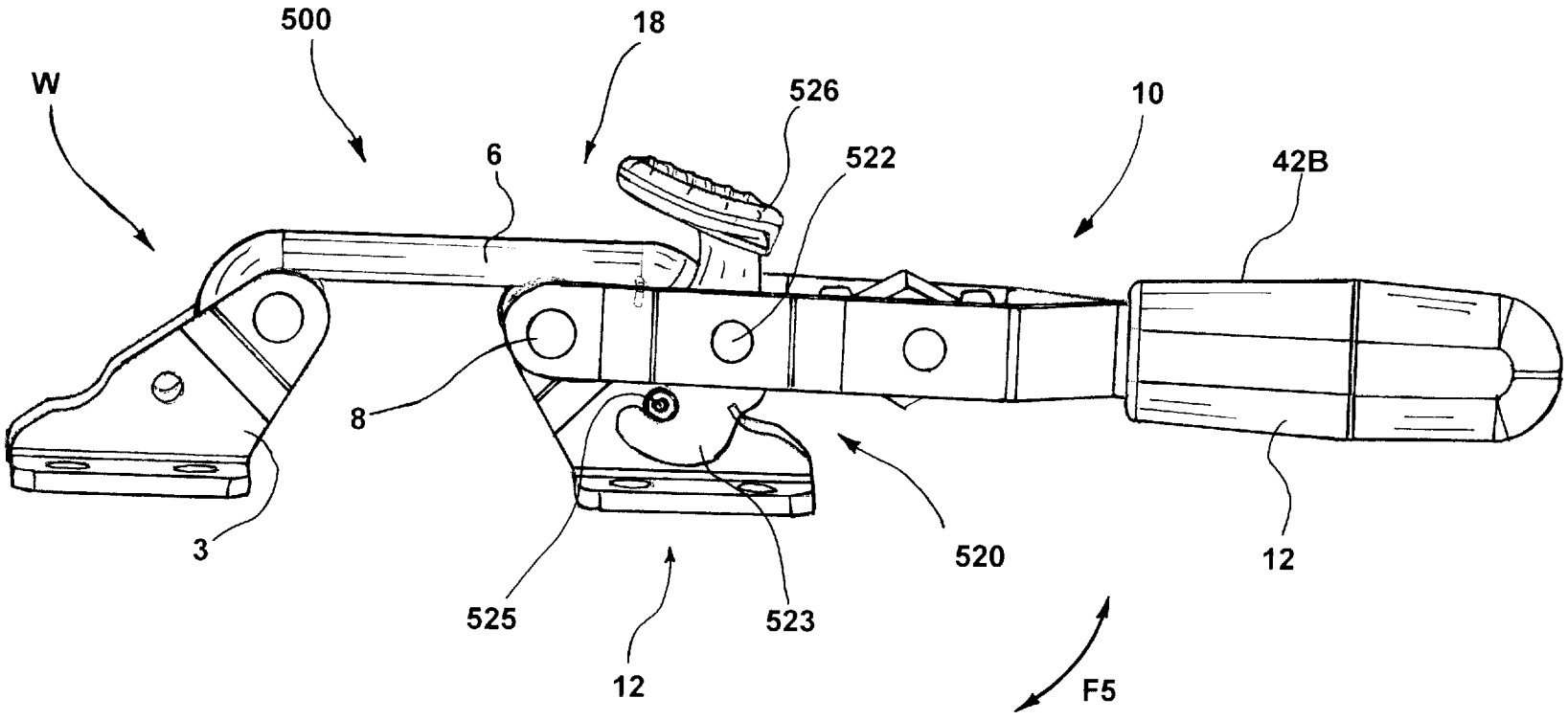
Figure 16:
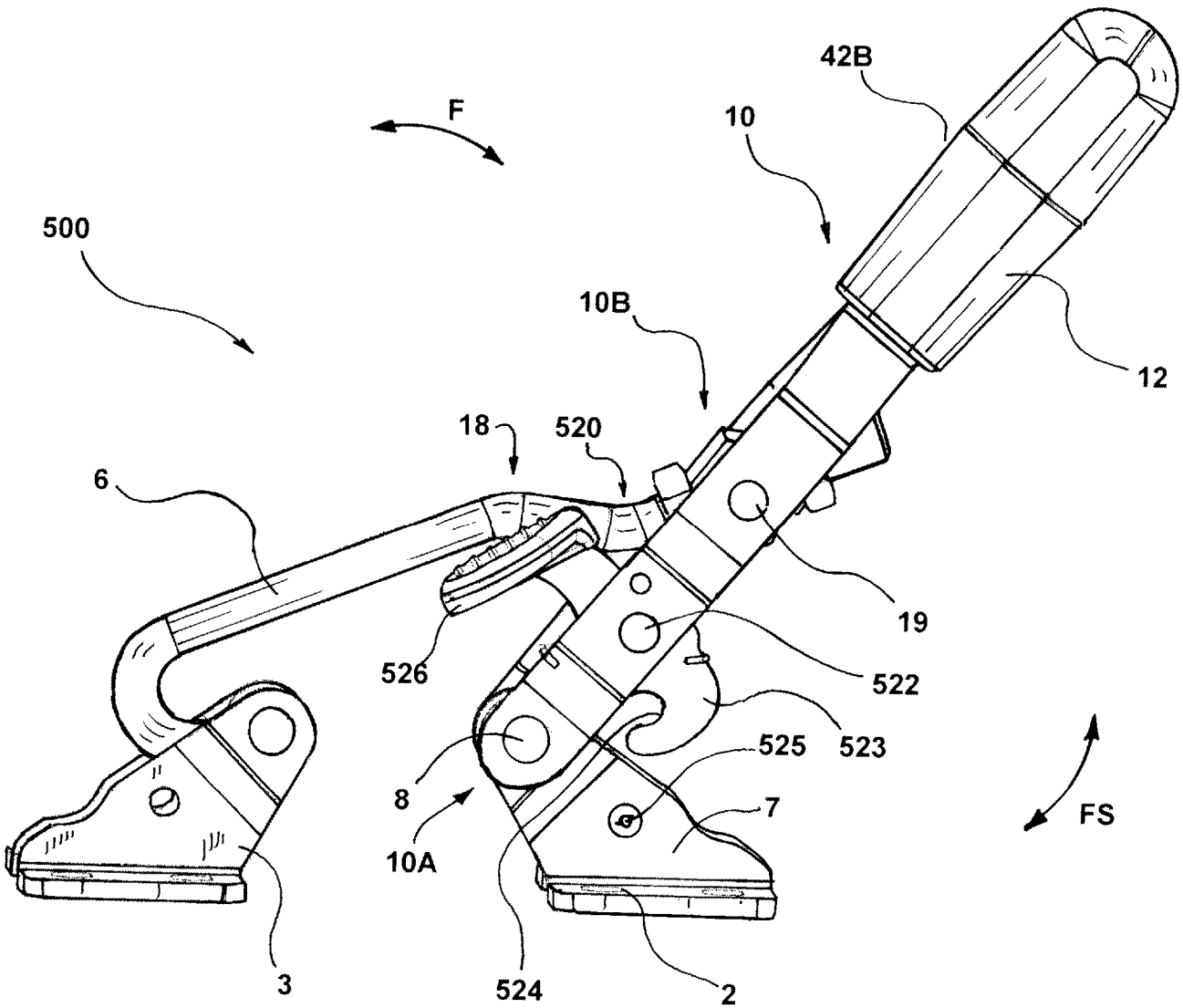
FIG. 16 is a side view of the device of FIG. 14, in a second operating configuration.
Figure 17A:
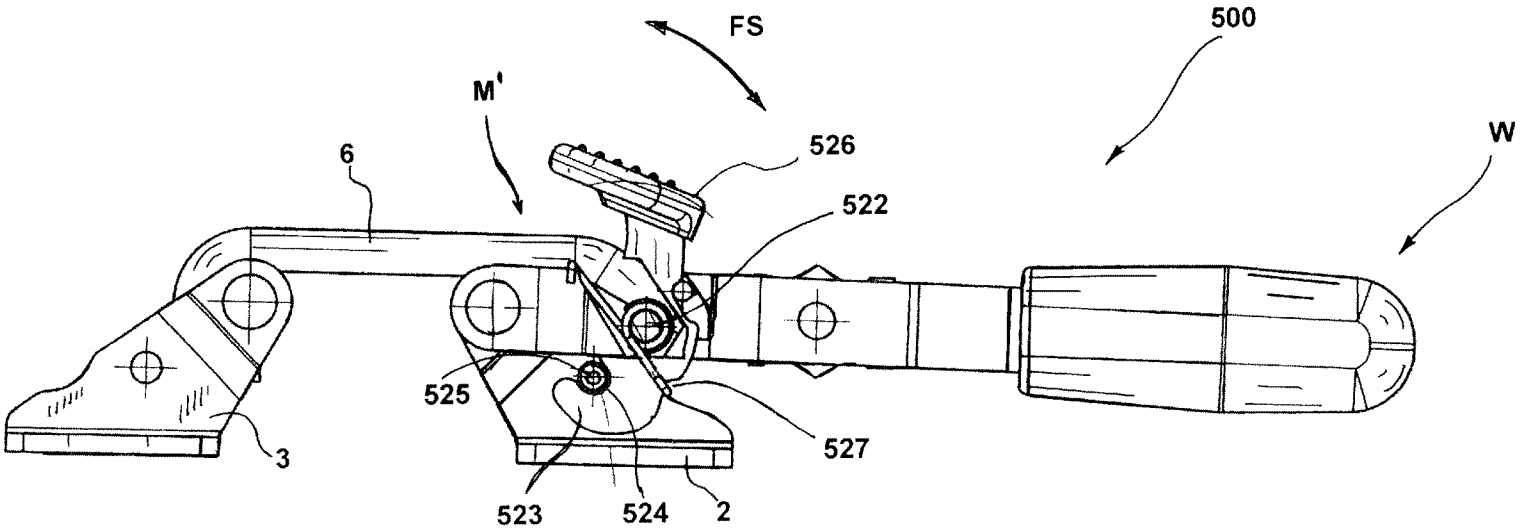
FIGS. 17A and 17B are sectional side views of the device of FIG. 14 in a closed configuration, with different configurations of the locking device.
Figure 17B:
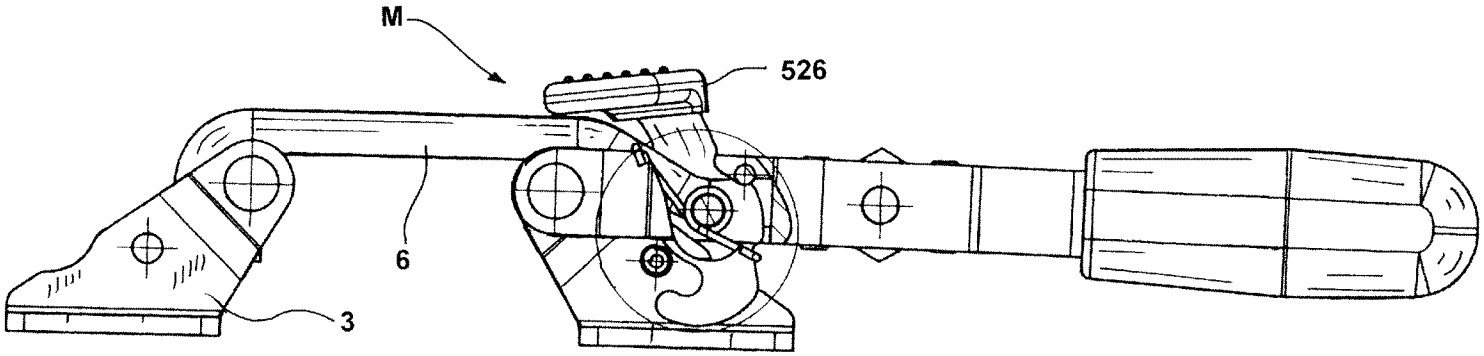

The locking device 520 is rotatable about a hinge pin 522 between a release position M shown in FIG. 17B, in which the gripping portion 526 is brought next to the hook 6 and is pressed against it or bears on it, and a locking position M' shown in FIGS. 14, 15 and 17A, in which the gripping portion 526 is spaced apart from the hook 6 and, with the clamp device in the closed configuration W, the catch element 523 is coupled to the catch pin 525.

As mentioned above, in this version also the presence of the stroke limiting means prevents the excessive rotation of the locking device 520, which might impede the correct operation of the clamp device.

In this configuration also, the gripping portion 526 can be actuated with the same hand as that used to take hold of the handle, and therefore the clamp device is easy and convenient to use, as well as being safe.

Thus the advantages discussed with reference to the preceding versions are also retained in this version.

The invention claimed is:

1. A clamp device adapted for fastening a first part of a container to be closed to a second part of the container, the clamp device comprising a base adapted to be fastened to said first part of the container, on which base is pivoted a handle which is rotatable about a pivot pin for opening and/or closing the clamp device, the handle comprising a pivot portion provided with a hole into which the pivot pin is inserted and a handgrip portion formed on the opposite end from the pivot portion, a closing device hinged at a second pivot pin to the handle and adapted to engage with a clamp element to close the clamp device in a closed configuration, the pivot pin and the second pivot pin being so positioned that their respective centers of rotation are spaced apart, wherein said closing device connects said base to a second base portion adapted to be fastened to said second part of the container to be closed, and a locking device positioned between said handle and said base, underneath the handle facing the base when in use, for locking the clamp device in the closed configuration, hinged by a hinge pin to the handle so that it can be moved between a locking position, in which, in the closed configuration, a catch element of the locking device interacts with the base to attach the clamp device to the base, and a release position in which the handle is free to rotate relative to the base, the hinge pin being interposed between the second pivot pin and the handgrip of the handle, wherein the locking device comprises a stroke limiting device to limit the rotation of the locking device from the locking position, and wherein the locking device is configured to be actuated between said handle and said base by an operator, wherein the locking device comprises a catch arm having a first end provided with a gripping portion, and an opposed second end provided with a catch element which is adapted to interact with the base to lock the clamp device, the arm being hinged on the hinge pin in its central portion, and wherein the stroke limiting device comprises a cut-out formed on a peripheral portion of the hinge head and the stroke limiting device is configured to slidably house a raised part provided on the handle, in such a way that, in rotation of the locking device the cut-out slides relative to the raised part, the cut-out and the raised part forming guide for the rotation of the locking device and acting as stroke limiting device to limit rotation of the locking device relative to the handgrip.

2. The device according to claim 1, wherein the stroke limiting device is provided on the locking device and is integral therewith.

3. The device according to claim 1, wherein the stroke limiting device is configured to allow a rotation of the locking device between about 2.5° and 15°, relative to the locking position.

4. The device according to claim 2, wherein the locking device comprises a catch arm having a first end provided with a hinge head in which a hole is formed for housing the hinge pin, and an opposed second end provided with a catch element adapted to interact with the base to lock the clamp device.

5. The device according to claim 1, wherein the stroke limiting device comprises a spring wound around the hinge pin with its opposite ends bearing, respectively, on the handle and on the gripping portion.

6. The device according to claim 1, wherein the catch element comprises a projection adapted to be inserted into a recess formed in the first base portion, so as to lock the clamp device.

7. The device according to claim 1, comprising a resilient return element configured to urge the locking device into the locking position.

8. The device according to claim 1, wherein the handle comprises a handgrip portion adapted to be grasped by an operator for opening and/or closing the clamp device, the handgrip portion extending in a mainly longitudinal direction along a longitudinal axis and being provided with a spur extending from the handgrip in a direction transverse to the longitudinal axis of the handgrip towards the base, so that, when the clamp device is in the closed configuration, the spur faces towards the first base portion, wherein the locking device comprises a gripping portion configured to be grasped by the operator to rotate the locking device, the gripping portion and the spur being provided on the same side of the handgrip;

wherein said spur improves safety of the locking device by reducing gaps in the device, and wherein said spur allows an operator to exert leverage on a wall of the spur to actuate the locking device, thereby increasing ease of the actuation of the device.

9. The device according to claim 8, wherein the spur comprises a projection, with a wall projecting from the handgrip in a direction transverse to the longitudinal axis away from an end of the handgrip, and is shaped so as to facilitate the gripping of the handgrip by the operator.

10. The device according to claim 9, wherein the wall is concave to facilitate the housing of the operator's finger, the concavity facing towards the end portion of the handgrip.

11. The device according to claim 10, wherein the spur further comprises a second wall extending from the handgrip to the free end of the wall in a direction transverse to the longitudinal axis.

12. The device according to claim 1, wherein the locking device comprises a gripping portion which is movable relative to the handle and is intended to be actuated by an operator in order to move the locking device.

13. The device according to claim 12, wherein the gripping portion comprises a free edge facing towards a second wall of the spur and intended to slide, during the actuation of the locking device, in a direction substantially parallel to the second wall.

14. A clamp device adapted for fastening a first part of a container to be closed to a second part of the container, comprising a base adapted to be fastened to said first part of the container, on which base is hinged a handle which is rotatable about a pivot pin for opening and/or closing the clamp device, and a closing device adapted to engage with a clamp element to close the clamp device in a closed configuration, wherein said closing device connects said base to a second base portion adapted to be fastened to said second part of the container to be closed, wherein the handle comprises a handgrip portion adapted to be grasped by an operator for opening and/or closing the clamp device, this handgrip portion extending in a mainly longitudinal direction along a longitudinal axis and being provided with a spur configured and arranged to facilitate gripping and actuation of the handgrip and to improve safety of the clamp device by the spur being configured and arranged to minimize a possible gap between the spur and a locking device of the clamp device to prevent a user's finger from being caught in said gap, said spur extending from the handgrip in a direction transverse to the longitudinal axis of the handgrip, towards the base, so that, when the clamp device is in the closed configuration, the spur faces towards the first base portion, wherein the locking device comprises a catch arm having a first end provided with a gripping portion, and an opposed second end provided with a catch element which is adapted to interact with the base to lock the clamp device, the arm being hinged on the hinge pin in its central portion, and wherein the stroke limiting device comprises a cut-out formed on a peripheral portion of the hinge head and the stroke limiting device is configured to slidably house a raised part provided on the handle, in such a way that, in rotation of the locking device the cut-out slides relative to the raised part, the cut-out and the raised part forming guide for the rotation of the locking device and acting as stroke limiting device to limit rotation of the locking device relative to the handgrip.

15. The device according to claim 1, wherein the stroke limiting device is configured to allow a rotation of the locking device between about 5° and 10°, relative to the locking position.

16. A clamp device adapted for fastening a first part of a container to be closed to a second part of the container, the clamp device comprising a base adapted to be fastened to said first part of a container, on which base is pivoted a handle which is rotatable about a pivot pin for opening and/or closing the clamp device, the handle comprising a pivot portion provided with a hole into which the pivot pin is inserted and a handgrip portion formed on the opposite end from the pivot portion, a closing device hinged at a second pivot pin to the handle and adapted to engage with a clamp element to close the clamp device in a closed configuration, the pivot pin and the second pivot pin being so positioned that their respective centers of rotation are spaced apart, wherein said closing device connects said base to a second base portion adapted to be fastened to said second part of the container to be closed, and a locking device positioned between said handle and said base, underneath the handle facing the base when in use, for locking the clamp device in the closed configuration, hinged by a hinge pin to the handle so that it can be moved between a locking position, in which, in the closed configuration, a catch element of the locking device interacts with the base to attach the clamp device to the base, and a release position in which the handle is free to rotate relative to the base, the hinge pin being interposed between the second pivot pin and the handgrip of the handle, wherein the locking device comprises a stroke limiting device to limit the rotation of the locking device from the locking position, and wherein the locking device is configured to be actuated between said handle and said base by an operator, wherein the locking device comprises a catch arm having a first end provided with a gripping portion, and an opposed second end provided with a catch element which is adapted to interact with the base to lock the clamp device, the arm being hinged on the hinge pin in its central portion, and wherein the stroke limiting device comprises a cut-out formed on a peripheral portion of the hinge head and the stroke limiting device is configured to slidably house a raised part provided on the handle, in such a way that, in rotation of the locking device the cut-out slides relative to the raised part, the cut-out and the raised part forming guide for the rotation of the locking device and acting as stroke limiting device to limit rotation of the locking device relative to the handgrip, and wherein the stroke limiting device comprises a spring wound around the hinge pin with its opposite ends bearing, respectively, on the handle and on the gripping portion.

* * * * *